United States Patent [19]

Campbell et al.

[11] 4,255,635

[45] Mar. 10, 1981

[54] KEYSWITCH

[75] Inventors: Dudley H. Campbell, Raleigh; James A. Daggerhart, Cary; Arthur W. Overton, Raleigh, all of N.C.

[73] Assignee: Stackpole Components Company, Raleigh, N.C.

[21] Appl. No.: 75,945

[22] Filed: Sep. 17, 1979

[51] Int. Cl.[3] ..... H01H 3/12; H01H 13/52

[52] U.S. Cl. ..... 200/159 A; 200/153 LA; 200/340; 200/281

[58] Field of Search ..... 200/159 A, 340, 153 LA, 200/281

[56] References Cited

U.S. PATENT DOCUMENTS 3,902,032 8/1975 Koepke ..... 200/159 A

FOREIGN PATENT DOCUMENTS 1540284 1/1970 Fed. Rep. of Germany ..... 200/159 A

*Primary Examiner*—Willis Little

*Attorney, Agent, or Firm*—Brown, Flick & Peckham

[57] ABSTRACT

A keyswitch includes a tubular plunger with a rectangular body slidably mounted in a rectangular housing that has a bottom wall provided in its top with a circular recess receiving the lower end of a coil spring extending up around a pair of upright spring contact strips, the lower ends of which are press fitted in the bottom wall. The inside of the plunger is provided with a cross member that normally separates the upper ends of the contact strips, but permits them to engage each other when a keycap on the upper end of the plunger is pushed down to lower the plunger. The plunger body has legs extending downwardly from its lower corners which engage the area of the housing between the plunger body and bottom wall of the housing while the plunger is in its upper position. The corners of the bottom walls are provided with downwardly extending sockets for receiving the plunger legs when the keycap is depressed.

6 Claims, 6 Drawing Figures

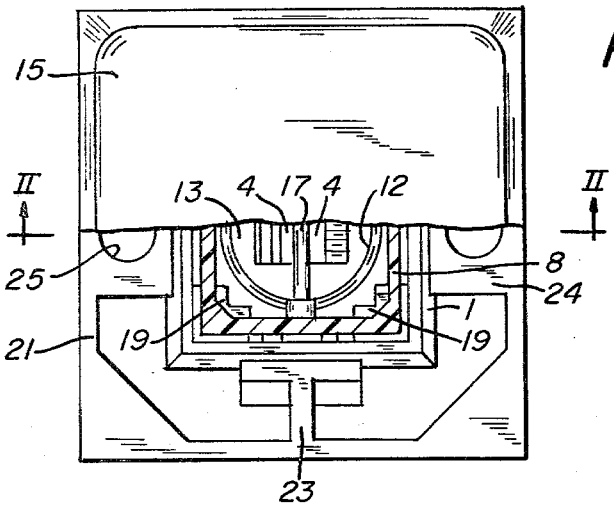
FIG. 1
FIG. 2
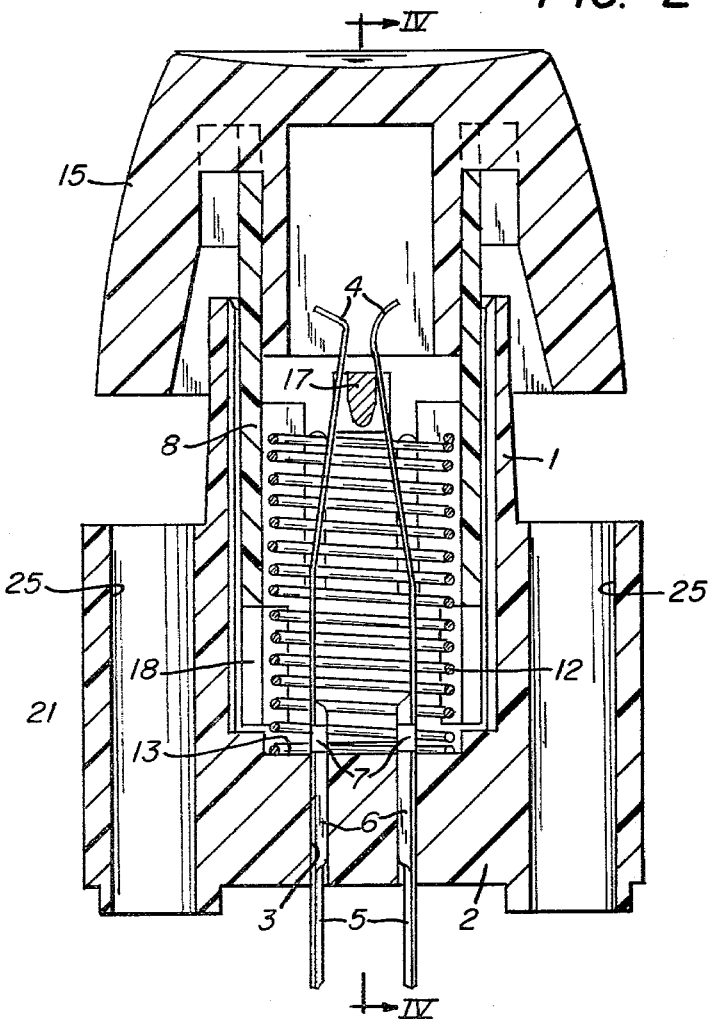

KEYSWITCH

The keyswitch disclosed in this application is of the type shown in U.S. Pat. No. 3,751,618, in which two upstanding spring contacts normally are held apart inside a plunger but are permitted to close when a keycap is depressed against the resistance of a return spring. The keyswitch disclosed herein is designed as an improvement on the patented keyswitch.

The preferred embodiment of the invention is illustrated in the accompanying drawings, in which FIG. 1 is a plan view, with part of the keycap broken away;

FIG. 2 is an enlarged vertical section taken on the line II—II of FIG. 1 and showing the switch open;

Figure 4:
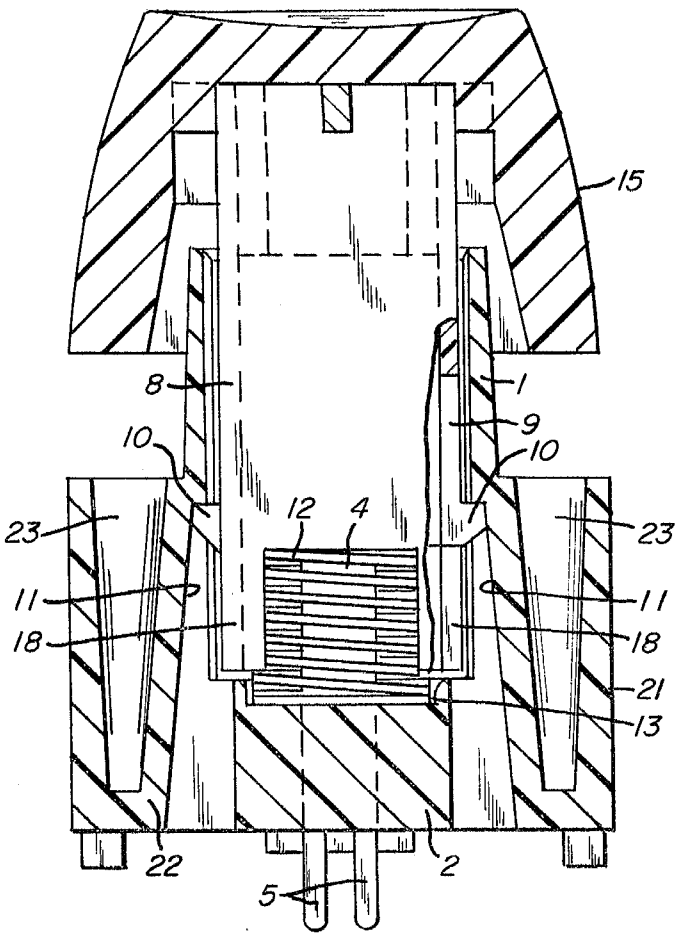
FIG. 4 shows the open keyswitch turned 90° from its position in FIG. 2, with the housing and keycap in vertical section and the plunger in elevation.

Referring to the drawings, a rectangular switch housing 1 has an open upper end and a lower end closed by a relatively thick bottom wall 2. The bottom wall is provided with a pair of laterally spaced slots 3 extending substantially vertically therethrough. Fitting tightly in these slots is a pair of spring contact strips 4 that project below the wall to form electric terminals 5 that may be plugged into a printed circuit board. The position of each contact strip in a slot 3 is provided with a pressed-out vertical rib 6 so that the strip has to be forced down through the slot to form a press fit. The distance the strip can be inserted in the slot is limited by tangs 7 projecting from opposite edges of the strip into engagement with the upper surface of bottom wall 2. This manner of holding the contact strips in place has the advantages that a defective strip can easily be pulled up out of the switch housing without removing the housing from the printed circuit board on which the housing is mounted, and a new contact strip then inserted in place of the defective one.

Figure 3:
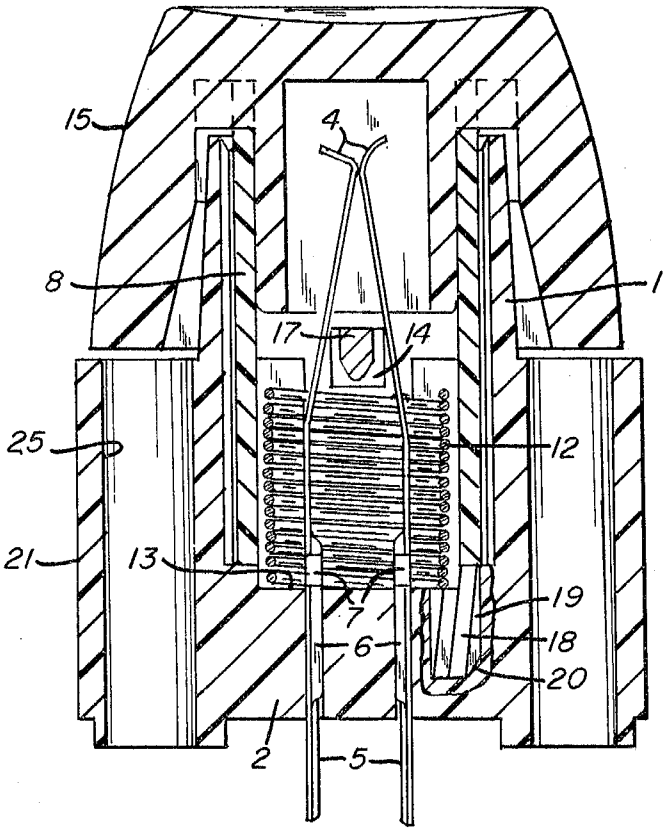
FIG. 3 is a view similar to FIG. 2, but showing the keycap depressed to permit the switch to close.
Figure 5:
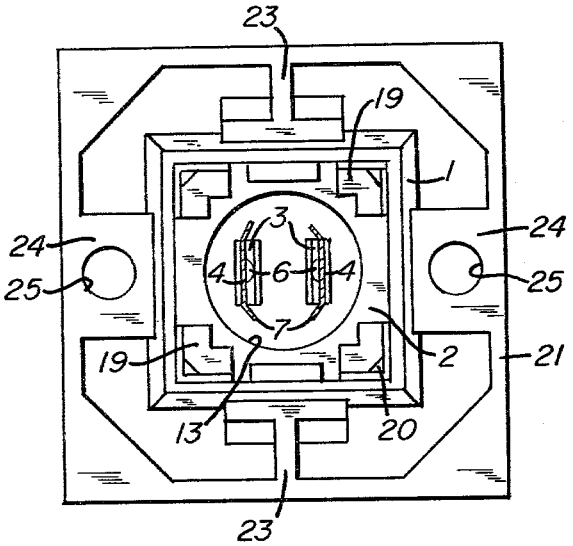
FIG. 5 is a plan view of the housing with the contacts shown in section.

The contact strips extend upwardly in the housing and their upper portions are inclined toward each other as shown in FIG. 3 sufficiently to come into engagement with each other near their upper ends. Above the engaging or contact point the two strips flare upwardly. One strip is solid, but the upper end of the other one preferably is provided with parallel longitudinal slits to form fingers that assure good contact with the other strip.

Figure 6:
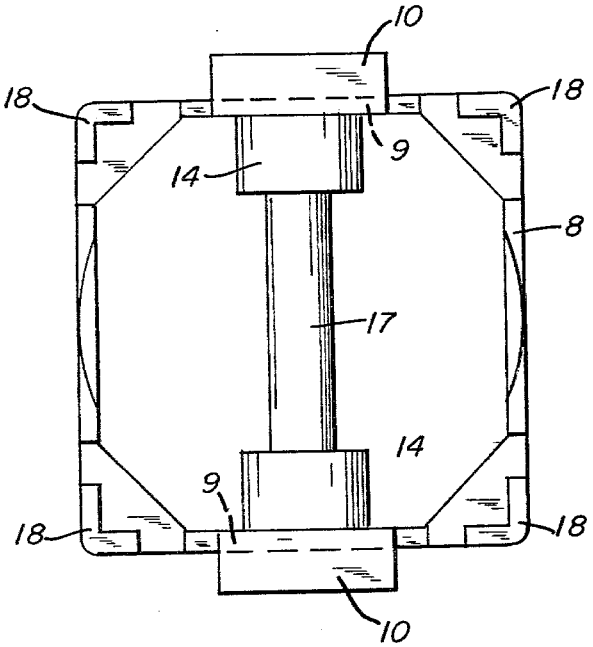
FIG. 6 is a still larger bottom plan view of the plunger.

Disposed in the switch housing is a tubular plunger that has a rectangular body 8 slidably engaging the housing for movement up and down in it. Two opposite sides of the plunger body are provided with upwardly extending slits to form tongues 9 that have outwardly projecting lugs 10 at their lower ends as shown in FIGS. 4 and 6. The lower portions of the housing side walls beside these tongues are provided with vertical slots 11, into which the lugs snap when the plunger is inserted in the housing. The purpose of the lugs is to limit upward travel of the plunger in the housing in order to lock it in the housing. The plunger normally is held in its upper position, determined by engagement of the lugs with the upper ends of slots 11, by a coil spring

12 seated in a recess 13 in the top of the bottom wall. The spring encircles the contact strips but is spaced from them. The fit of the lower end of the spring in the recess prevents any lateral shifting of the spring that might cause it to engage the contacts. The upper end of the spring engages projections 14 on the side of the plunger. While the plunger is held in its upper position by the spring, the lower end of the plunger body is spaced from the bottom wall of the housing as shown in FIG. 2. Mounted on the upper end of the plunger is a keycap 15 for depressing the plunger against the resistance of the coil spring.

While the plunger is in its upper position shown in FIG. 2, the two contact strips are held apart by a cross member 17 in the plunger that is integrally connected with the two projections 14. The lower portion of this cross member is tapered downwardly so that as the plunger is being assembled with the housing the cross member will easily slide down between the upper ends of the contact strips as it spreads them apart. In the upper position of the plunger this cross member holds the contact strips out of engagement with each other. When the keycap is depressed, as shown in FIG. 3, the cross member is moved down out of engagement with the contacts and thereby permits them to move together to complete a circuit through the switch.

It is a feature of this invention that in spite of the relatively thick bottom wall of the housing and the resulting relatively short body of the plunger, there is enough length of the plunger engaging the housing when the plunger is in its upper position to prevent wobble of the plunger and keycap. Accordingly, as shown in FIGS. 2, 4 and 6, the plunger body has legs 18 extending downwardly from its four corners for engaging that area of the housing between the plunger body and the bottom wall of the housing while the plunger is elevated. In other words, the plunger engages the housing for substantially the full length of the inside of the housing while the plunger is raised. To permit the plunger to be depressed, the corners of the bottom wall are provided with downwardly extending sockets 19 for receiving the plunger legs 18. Preferably, each leg has two sides at right angles to each other for engaging two adjoining sides of the housing, and each socket has flat sides forming continuations of the housing sides above it. To cushion the plunger when it reaches the bottom of its travel, the bottom of each socket may be provided with an inclined stop 20 at the corner formed by its flat sides. This stop is so positioned that as a leg nears the lower end of the socket it engages the inclined stop and is deflected by it slightly toward the center of the bottom wall. This flexing of the legs to deflect them absorbs energy and thereby resists downward travel of the plunger at the lower extent of its travel. This cushioning effect eliminates the sharp impact of the plunger against the housing that otherwise would occur.

To facilitate mounting the switch in place, it is preferred to surround the lower portion of the housing by an outer wall 21 that is square and has a thin bottom wall 22 (FIG. 4) connected with the thick bottom wall of the housing. Suitable vertical ribs 23 and 24 connect this outer wall with the side walls of the housing. Ribs 24 are provided with vertical passages 25 for receiving screws to hold the housing on a printed circuit board. A snap-in type of mounting can be used if the keyswitch is to be mounted on a panel.

Except for the spring and the contact strips, all of this keyswitch preferably is formed from molded plastic. In practice, the outer wall 21 measures 0.740" square to be sure that several of the switches can be mounted side by side in both directions on 0.750" centers.

According to the provisions of the patent statutes, we have explained the principle of our invention and have illustrated and described what we now consider to represent its best embodiment. However, we desire to have it understood that, within the scope of the appended claims, the invention may be practiced otherwise than as specifically illustrated and described.

We claim:

1. A keyswitch comprising a rectangular housing having a bottom wall and an open upper end, a plunger having a rectangular tubular body extending downwardly in the housing and slidably engaging said housing for movement up and down therein, means limiting upward travel of the plunger to a predetermined elevated position, the lower end of said body being spaced above said bottom wall while the plunger is in said elevated position, said bottom wall being provided with a pair of laterally spaced openings extending substantially vertically therethrough, a pair of spring contact strips rigidly mounted in said openings and projecting below said wall to form terminals, said contact strips also extending up inside the plunger and having normally engaging upper ends, a cross member inside the plunger body and supported thereby between the contact strips, and a coil spring inside the plunger below said cross member and encircling the contact strips but spaced therefrom, the top of said bottom wall being provided with a central recess receiving and positioning the lower end of the spring, said spring normally holding the plunger in said elevated position with said cross member spreading the upper ends of the contacts apart, said downward movement of the plunger in said housing disengaging said cross member from the contacts, the plunger body having legs extending downwardly from its lower corners to slidably engage said housing between said body and bottom wall while the plunger is elevated, and the corners of said bottom wall being provided outwardly of said recess with downwardly extending sockets for receiving said legs when said plunger is depressed.

2. A keyswitch according to claim 1, in which each of said plunger legs substantially engages two adjoining sides of said housing.

3. A keyswitch according to claim 1, in which each of said plunger legs has flat sides substantially engaging two adjoining sides of said housing, and each of said sockets has flat sides forming continuations of said housing sides.

4. A keyswitch according to claim 1, in which said pair of laterally spaced openings are parallel slots, the portion of each of said spring contact strips in a said slot is provided with a pressed-out vertical rib to provide a press fit between the strip and said bottom wall, and each of said strips is provided with laterally projecting tangs overlying the bottom of said recess in engagement therewith.

5. A keyswitch according to claim 1, including a keycap on the upper end of the plunger for pushing it down in said housing.

6. A keyswitch according to claim 1, in which the bottom of each of said sockets has an inwardly and downwardly inclined surface for engagement by the lower end of the overlying plunger leg when the plunger is depressed, whereby to deflect the leg inwardly.

* * * * *